United States Patent [19]

Van Egmond et al.

[11] 4,234,390

[45] Nov. 18, 1980

[54] SYSTEM FOR CONTROL OF A COKING PLANT

[75] Inventors: Jacobus H. Van Egmond, Alkmaar; Lichtenveldt, Castricum, both of Netherlands

[73] Assignee: Hoogovens IJmuiden, B. V., IJmuiden, Netherlands

[21] Appl. No.: 902,369

[22] Filed: May 3, 1978

[30] Foreign Application Priority Data

May 11, 1977 [NL] Netherlands ..... 7705188

[51] Int. Cl.[3] ..... C10B 5/00; C10B 27/04; C10B 45/00

[52] U.S. Cl. ..... 202/262; 201/1; 202/270

[58] Field of Search ..... 202/262, 263, 270; 201/1, 35, 41

[56] References Cited

U.S. PATENT DOCUMENTS

| | | | |
|---|---|---|---|
| 2,975,109 | 3/1961 | Van Ackeren | 202/263 |
| 3,491,356 | 1/1970 | Schüroff | 202/262 |
| 3,647,053 | 3/1972 | Palumbo | 201/1 |
| 4,067,461 | 1/1978 | Sperduti | 202/262 |
| 4,072,885 | 2/1978 | Emark | 202/262 |
| 4,105,503 | 8/1978 | Bruce | 202/263 |

FOREIGN PATENT DOCUMENTS

| | | | |
|---|---|---|---|
| 2416558 | 10/1974 | Fed. Rep. of Germany | 202/263 |
| 2416524 | 11/1974 | Fed. Rep. of Germany | 202/263 |

*Primary Examiner*—Bradley R. Garris

*Attorney, Agent, or Firm*—Stevens, Davis, Miller & Mosher

[57] ABSTRACT

A coking plant in which steam is injected into the ascension pipe of each coking chamber during charging of coal into the chamber and during an initial portion of the coking time, in order to maintain a slightly subatmospheric pressure in the chamber. Timing means which stops the injection of steam at the end of a suitable period of time after charging is actuated to start timing this period by a command signal sent from the coke pusher machine, which also levels the coal after charging, via induction coils provided for ascertaining the correct alignment of the coke pusher machine and the coke chambers.

1 Claim, 5 Drawing Figures

SYSTEM FOR CONTROL OF A COKING PLANT

BACKGROUND OF THE INVENTION

1. Field of the Invention

This invention relates to a coking plant and is concerned with the control of the plant in order to minimize undesirable emission of smoke, fumes etc. to the atmosphere.

2. Description of the Prior Art

Earlier filed U.S. patent application Ser. No. 870,138, filed Jan. 17, 1978, describes a method of emission-control in a coking plant in which, during charging of each coking chamber and during an initial period of the coking process after charging, a sub-atmospheric pressure of a few mm water column is created in the chamber by injection of steam into the gas ascension or vent pipe of the chamber. In this way emission of gas, dust, etc. during charging and the initial stage of coking is controlled and minimized.

In order to carry out this method, there is provided timing means in the form of a time clock which effects closure of the steam valve admitting steam to the vent pipe of the chamber at the desired moment, typically 30 minutes, after the beginning of the coking time. A signal is given to the clock to start timing the period at the end of which the steam injection is to be stopped. This signal is given from the coke pusher machine which also levels the coal, during levelling of the coal in the fully charged chamber. The clock is described as being actuated pneumatically by an air pulse sent by the coke pusher machine.

SUMMARY OF THE INVENTION

The object of the invention is to improve, simplify and keep reliable the coking plant described above.

More generally, an object of the invention is to provide a coking plant in which undesired emissions to the atmosphere from the coking chambers is minimized.

The invention is based on the realization that to start the timing means in the coking plant described it is just as well or even better to make use of equipment already provided for different purposes. For control of the coke-manufacturing process which lends itself to a certain degree of automation, the coking plant is equipped with a central data-processing machine which supplies information to the coal-charging car, the coke pusher machine, the door machine and the coke-quenching car about charging and pushing out of the ovens, and dumping of coke, and which, in reverse, receives information from the machines, so that at any moment the condition of all the ovens is known (see British patent specification No. 1,411,025).

To achieve accurate positioning of the coke pusher machine and the door machine in relation to the ovens, induction coils are provided on the platforms on both sides of the oven battery in the centre of each oven chamber, and corresponding coils are provided on both machines. Accurate positioning of a machine is achieved as soon as the coil of the oven concerned is coupled with coil or coils of the machine in question. If the pusher machine and door machine are positioned opposite the same oven a means of communication via the induction coils is created between the two machines themselves and the central control, and information can be exchanged between the machines and the central control. The use of these induction coils (also called sensors) for mutual positioning and transmission of data and commands is known (see the periodical "Holecpost", 9th vol. no. 3, July 1973, page 9, where the "cross-battery-interlock system" of coking plant No. II of Hoogovens IJmuiden B.V. is described).

The present invention proposes that effective use be made of these induction coils located on the coke pusher machine.

According to the present invention the said timing means is electrically operated, and is arranged to be actuated to start timing a said period of time by a command transmitted from the coke pusher machine via the said induction coils.

The advantages obtainable with the invention are that no large additional cost investments are required, that from an electronic point of view the system can be simply constructed and that there is little or no risk of contamination.

BRIEF DESCRIPTION OF THE DRAWINGS

An embodiment of the invention will now be described by way of non-limitative example with reference to the accompanying drawings, in which.

DESCRIPTION OF THE PREFERRED EMBODIMENT

Figure 1:
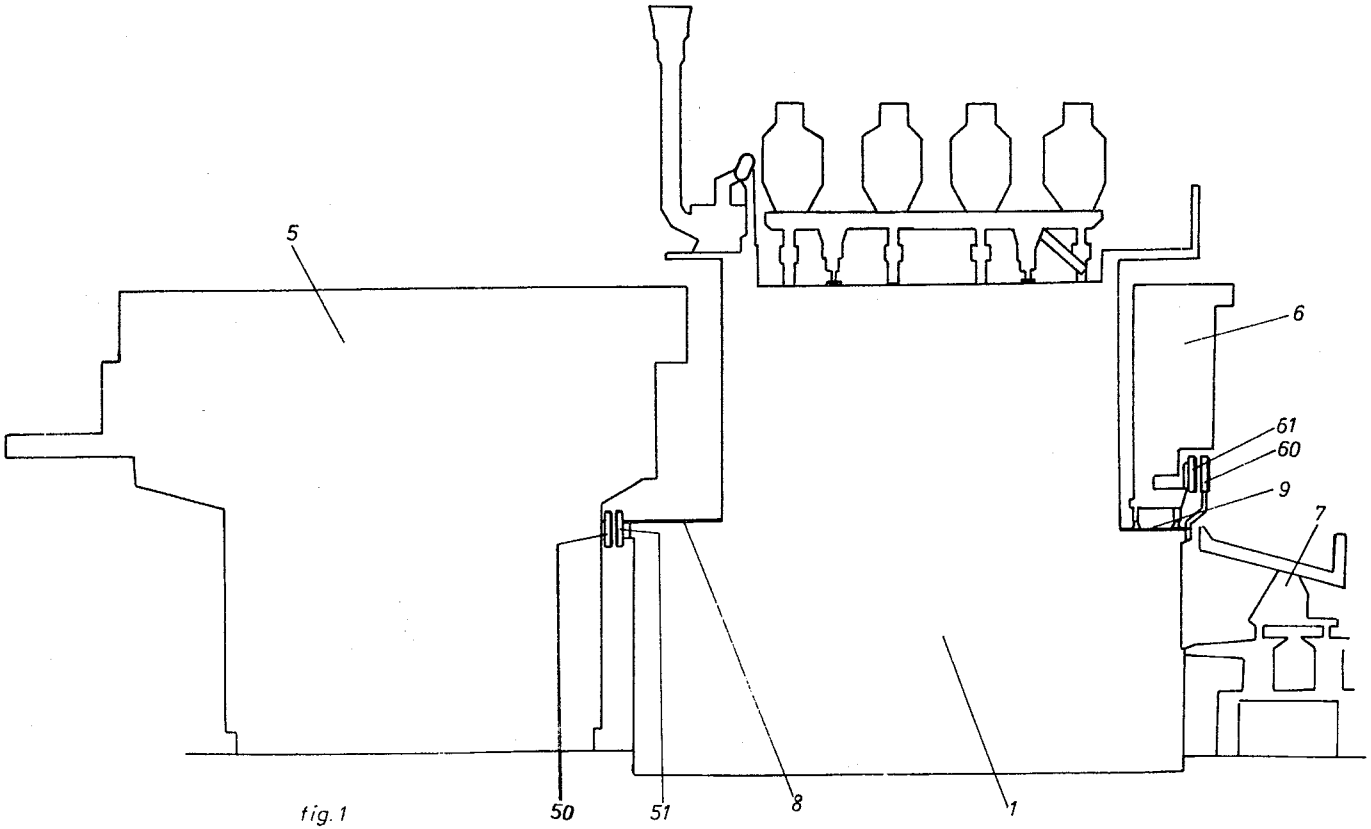
FIG. 1 is a schematic side view of an existing coking plant.
Figure 2:
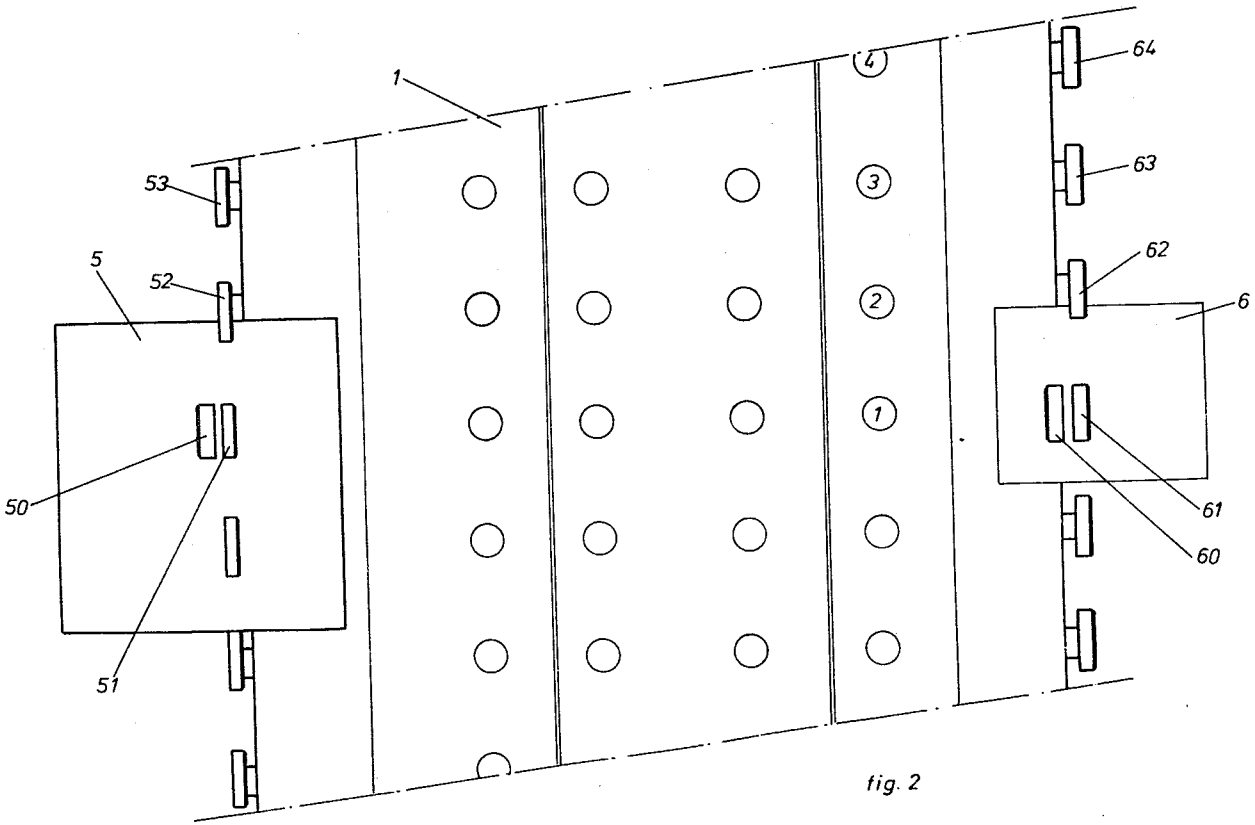
FIG. 2 is a schematic top view of the existing means of communication in the plant of FIG. 1, making use of induction coils.

As FIGS. 1 and 2 show, the coking plant illustrated is of the type described and illustrated in patent application Ser. No. 870,438 referred to above, and comprises a row of horizontal coke chambers 1,2,3,4, . . . each, with doors on both sides, and a coke pusher machine 5 movable along the row of chambers. On the other side of the battery of chambers, a mobile door machine 6 and a coke-quenching car 7 are provided, the details of which do not add to a better understanding of the present invention and can, therefore, be omitted. Each coke chamber is equipped with at least one ascension pipe I ending in a gas collecting main. Each coke oven 1,2,3,4, . . . can be charged with coking coal through a number of closable charging holes in the chamber roof. In each ascension pipe there is provided a steam injector which can be connected to a steam conduit via a steam valve.

For checking the positioning of the pusher machine 5 on one side and of the door machine 6 on the other side of each chamber, induction coils 51,52,53,54 . . . and 61,62,63,64 . . . (see FIG. 2) are provided on platforms 8 and 9 (FIG. 1) on both sides of the chamber battery in the centre of each oven chamber 1,2,3,4, . . . A coil 50 is fitted on the coke pusher machine 5 and a coil 60 on the door machine 6.

The coking plant is equipped, for instance housed in a room in its coal bunker, with a central control unit 80 (FIG. 3) of the type described in British patent specification No. 1,411,025, which receives and provides such essential data as the number of a chamber requiring an operation, the required operation (pushing, quenching or dumping), the coking time etc. and in which commands are derived to ensure for example that the quenching car 7 is moved to the correct position at the correct time. Monitoring by means of two sets of the induction coils, mutual interlocking may be achieved, so that for instance pushing coke out of a chamber can only take place if the door machine 6, the coke pusher machine 5 and the quenching car 7 are correctly positioned with respect to the chamber.

The connection created via the induction coils (or sensors) is a semi-duplex connection. The information is transmitted in the form of a telex message. Each message contains 6 bits, the first bit (key-bit) of which serves to synchronise the oscillators on the door and coke pusher machines with the oscillator in the platforms 8 and 9. Thus this first bit or key-bit is not an information bearer. After the key-bit, five bits are transmitted, each of which may be "0" or "1", so that with these five bits thirty-two combinations can be made. However, the message is transmitted for checking purposes once normally and a second time inverted, as a result of which the number of possibilities is halved to sixteen. The number of messages passed is twenty per second and therefore after checking ten a second; the pulse repetition frequency used is 1 kHz.

Figure 3:
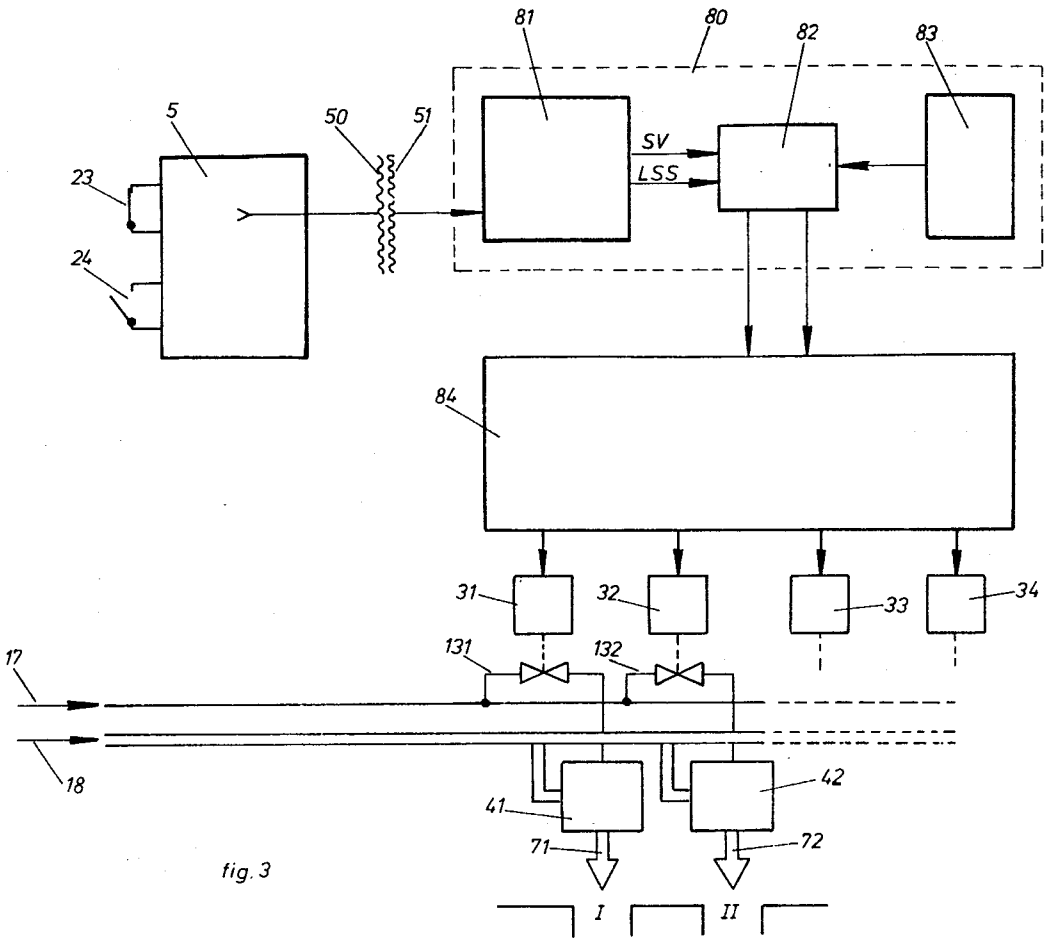
FIG. 3 is a block diagram of the improved equipment embodying the invention.

As described in patent application Ser. No. 870,138 referred to above, provision is made for creating a sub-atmospheric pressure (a few mm of water column below atmospheric) during charging of a chamber and for an adjustable period at the beginning of the coking process. In this embodiment, the timing means which measures this adjustable period is electronic. In FIG. 3, the coke pusher machine 5 is indicated by the induction coil 50 opposite the induction coil 51 of the chamber 1. The coil 51 is connected to the central control unit 80, which inter alia comprises a mutual interlocking system 81, an oven-selecting unit 82 and a data-processing unit 83 all merely indicated in the Figure. Additionally, there is a steam control unit 84 which is connected to the oven-selecting part 82 in the central control unit 80. The selective outputs of the unit 84 are connected to electromagnetic valve coils 31, 32, 33, 34 . . . , associated with the respective chambers 1,2,3,4, . . . which open and close corresponding valves 131, 132, 133, 134 . . . Each valve 131, 132 . . . is connected to a compressed-air line 17. For the respective chambers, steam valves 41, 42, 43, 44 . . . actuated by compressed air are connected to a steam conduit 18 to admit steam when opened to respective injectors 71, 72, 73, 74 . . . in the respective ascension pipes I, II . . . When one of the valve coils 31, 32, 33, 34 . . . is energised, the corresponding compressed-air valve 131,132, . . . is opened and the corresponding steam valve 41, 42 . . . is opened. Steam can then flow from the steam conduit 18 to the steam injector 71, 72 . . . in question and into the associated ascension pipe I, II . . . , to create the required sub-atmospheric pressure in the corresponding chamber 1,2,3,4 . . .

On the control panel in the control cabin of the coke pusher machine 5, there is a push-button 23 which can be manually operated by the operator to give the command "steam into the ascension pipe". On the same panel is a switch 24 which is operated upon the command "levelling completed". Pressing button 23 is not effective until the machine has been positioned and the remaining conditions which permit injection of steam into the ascension pipe have been met.

By pushing button 23 an additional signal is generated by the local oscillator on the pusher machine 5, which signal is converted into a binary code and transmitted as a series of pulses after the other signals for commands and messages via the coils (coil 50 and one of the coils 51,52,53,54 . . . ).

From the unit 83, the number of the chamber arrives in the form of octal numbers in the input buffers of the unit 82, which distinguish between selection and logic. Furthermore, the command "steam into the ascension pipe" arrives from the locking system 81 via a line SV and the command "leveller coil selected" via a line LSS.

The correct oven (which has just been charged and must be kept under sub-atmospheric pressure for a period) is selected by decoders also included in unit 82. When the button 23 in the coke pusher machine 5 is pressed to give the command "steam", an electronic counter with an adjustable clock frequency in unit 84 starts working. This counter directly operates a bistable flip-flop circuit through which the appropriate one of the valve coils 31,32,33,34 . . . is energised as long as the counter functions. Thus corresponding one of the air valves 131, 132 . . . and the corresponding one of the steam valves (141, 142 . . . ) are opened, and steam is injected via the steam valve into the injector in the relevant ascension pipe (I, II . . . ) of the chamber. In the meantime another oven can be charged and subsequently be placed under sub-atmospheric pressure in the same way.

At the end of the time period predetermined by the clock frequency, the valve coil 31, . . . ceases to be energised, so that the air valve 131, . . . and the corresponding steam valve close and sub-atmospheric pressure is no longer created in the oven by injection of steam into the ascension pipe.

The operator of the coke pusher machine cannot select an oven; this is done by the oven selection part 82. From coke pusher machine 5, the operator can only give the command, which he does when it seems appropriate to him, that steam should be injected into the ascension pipe of a given chamber.

Figure 4:
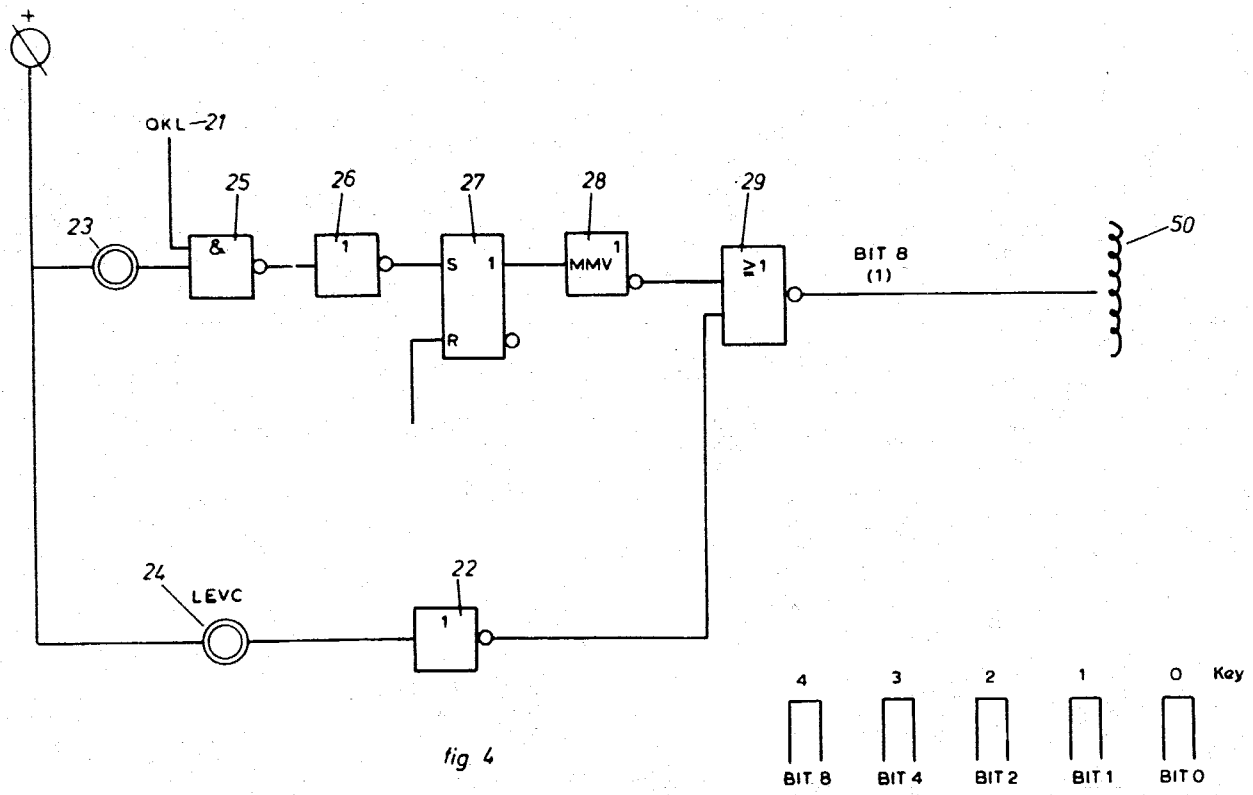
FIG. 4 is a block diagram of the electronic equipment on the coke pusher machine in the plant embodying the invention.
Figure 5:
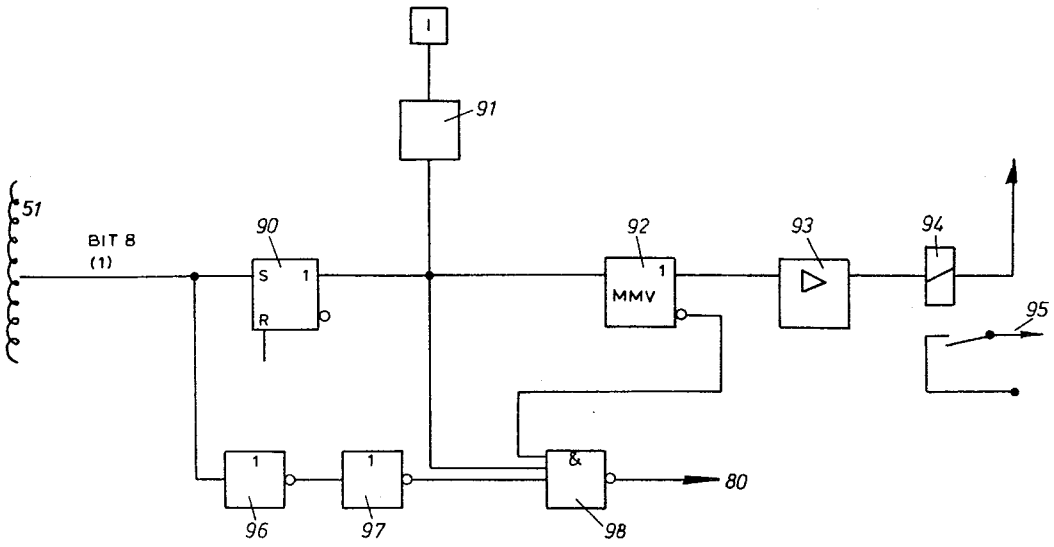
FIG. 5 is a block diagram of the electronic equipment in the coking plant in so far as it is relevant to the present embodiment.

FIGS. 4 and 5 together show how, upon the command "steam", transmission of the signal between coke pusher machine and central processing unit takes place, making use of standardised modules. In these two Figures, standardised electrotechnical symbols in accordance with Dutch standard NEN 5152 are used.

FIG. 4 shows the push-button 23, by which the operator in the coke pusher machine initiates transmission to the control unit 84 of the command "inject steam". The push-button 23 is connected to a NAND gate 25, the other input to which 21 is formed by a command "levelling permitted". The output of this NAND gate 25 leads to a negator 26, the output of which is connected to the S-input of a flip-flop circuit 27. The other input R of this flip-flop circuit can receive the command "move pusher machine". The output of flip-flop circuit 27 indicated by the reference numeral 1 is connected to the input of a mono-stable multi-vibrator 28, which delivers a pulse series of one second duration, no matter the length of time for which the button 23 is pushed. Only the O-output of this mono-stable multivibrator is used, being connected to a NOR gate 29.

A contact 24 by which the operator gives the command "level" which contact is also connected to the positive terminal, is connected as an input to a negator 22, whose output is connected to the second input of the NOR gate 29. The output of this NOR gate 29 is connected to the sensor coil 50. The inscription bit 8 (1) denotes that the signal has the value 1 if bit 8 is present.

FIG. 5 shows the connecting circuit between sensor coil 51 and the electromagnetic valve. The signal originating from sensor coil 51 has the value 1 if the bit 8 is present. This signal is fed to a flip-flop circuit 90 as a first input S. The second input R is the signal denoting that a new chamber is being selected. One of the outputs, i.e. the output 1, of the flip-flop 90 is being used and leads to a monostable multivibrator 92 as sole input. An indicator 91 provides an indication about the presence of a signal on the conduit concerned. The monostable multivibrator 92 has two outputs, one of which (output 1) is connected to an amplifier 93, the output of which controls a relay 94. A contact 95 of the relay 94 is included in the circuit for one of the electromagnetic coils 31, 32, 33, 34 . . . so that when the relay in question is energised, the corresponding magnet coils are also energised.

Between the flip-flop circuit 90 and the multivibrator 92 there is a connection with a NAND gate 98 which has three inputs. The second input is formed by the O-output of the monostable multivibrator 92 and the third one is formed by the original signal, which has however undergone a transit-time delay in order to make allowance for the switching times of the flip-flop circuit 90, (this is achieved by two negators 96 and 97). The output of the NAND gate 98 leads to the central processing unit 80.

The flip-flop circuit 90 is switched by the incoming signal and in the monostable multivibrator this signal is prolonged, e.g. to 1.5 seconds, in order to ensure that the series of pulses representing the command "inject steam" is no longer present.

By this measure, i.e. by distinguishing by prolongation between the commands "inject steam" and "levelling completed", errors and confusion are prevented.

Thus, on depression of the SV-button 23, a pulse series of one second duration is sent to the sensor coils 50, 51 by the monostable multivibrator 28. By means of the circuit shown in FIG. 5, it is then achieved that steam is injected into the corresponding ascension pipe of the oven.

Should, however, the operator on the coke pusher machine forget to operate the SV-contact 23, then the command will nevertheless arrive by another route, from the oven-selection unit 82, but now in a continuous form, automatically upon the closure of levelling contact 24. The central processing unit 80 then distinguishes between the first impulses up to a total duration of 1.5 seconds for delivering the command "inject steam", after which steam is still injected, while the further pulses are processed by the normal procedure for "levelling completed".

We claim:

1. In a coking plant having a row of coking chambers for the coking of coal by dry distillation, a coke pusher machine movable along the row for pushing coke out of each chamber after coking of a charge of coal therein, a coke leveller member mounted on the coke pusher machine and movable to level the coke charge in a chamber before coking, induction coils arranged on the row of chambers and on the coke pusher machine for use in ascertaining by means of said induction coils the correct alignment of the coke pusher machine in relation to a given chamber, central data processing means which effects interlocking of operations in the coking plant, coking time control and coke oven selection, an ascension pipe for each chamber for the discharge from the chamber of the gases evolved during coking, means for injecting steam into the ascension pipe through a steam valve controlling passage of steam into the pipe, which valve is controlled by an electromagnetically operated air valve so as to create a sub-atomospheric pressure in the chamber and timing means for control of said injecting means, which timing means, after a chamber has been charged with coal, stops the injection of steam to the ascension pipe of that chamber when a period of time has elapsed following the commencement of the coking process in the chamber, the improvement wherein the said timing means is electrically operated, is arranged and constructed to be actuated to start timing a said period of time by a command transmitted from the coke pusher machine via the said induction coils in the form of a series of electrical pulses, the timing means being connected to the data-processing means which is arranged so that the timing means cannot be actuated to start timing a said period in respect of a selected oven until the coking plant is in a desired condition for charging of that chamber, the timing means comprising a pulse counter and a pulse frequency generator which is adjustable to vary the frequency, there being a bistable flip-flop circuit between the said pulse counter and the said air valve, which circuit controls the air valve.

* * * * *

UNITED STATES PATENT AND TRADEMARK OFFICE

CERTIFICATE OF CORRECTION

PATENT NO. : 4,234,390

DATED : November 18, 1980

INVENTOR(S) : Jacobus H. VAN EGMOND et al

It is certified that error appears in the above-identified patent and that said Letters Patent are hereby corrected as shown below:

Under the names of the Inventors: before "Lichtenveldt"

insert -- Willem F. --

Signed and Sealed this

*Twenty-eighth* Day of *April 1981*

[SEAL]

*Attest:*

RENE D. TEGTMEYER

*Attesting Officer*

*Acting Commissioner of Patents and Trademarks*